US006379262B1

(12) United States Patent
Boone

(10) Patent No.: US 6,379,262 B1
(45) Date of Patent: Apr. 30, 2002

(54) SET OF GOLF CLUB IRONS

(76) Inventor: David D. Boone, 21501 Rushford, El Toro, CA (US) 92630

( * ) Notice: Subject to any disclaimer, the term of this patent is extended or adjusted under 35 U.S.C. 154(b) by 0 days.

(21) Appl. No.: 09/490,179

(22) Filed: Jan. 22, 2000

Related U.S. Application Data

(60) Provisional application No. 60/116,939, filed on Jan. 23, 1999.

(51) Int. Cl.[7] ..... A63B 53/04
(52) U.S. Cl. ..... 473/324; 473/342; 473/350
(58) Field of Search ..... 473/346, 332, 473/350, 349, 324, 342

(56) References Cited

U.S. PATENT DOCUMENTS 5,014,993 A * 5/1991 Antonious
5,377,985 A * 1/1995 Ohnishi
5,595,552 A * 1/1997 Wright
5,669,824 A * 9/1997 Aizawa
5,676,605 A * 10/1997 Kobayashi
5,967,903 A * 10/1999 Cheng

* cited by examiner

*Primary Examiner*—Stephen Blau

(57) ABSTRACT

An improved set of golf club irons wherein each golf club iron club head has a structure for redistributing weight of the club head towards the perimeter thereof particularly in the rear cavity region. This is accomplished by enlarging the rear cavity surface, creating an undercut between said rear cavity surface and cavity perimeter further redistributing available weight toward the club head perimeter. In addition, the club head face thickness is reduced between the rear cavity surface and hitting surface allowing additional weight to be redistributed to the club head perimeter resulting in a larger thin faced cavity. The large thin faced cavity is reinforced by means of a lightweight web-like structure comprised of thin lightweight buttresses which protrude outward from the center of the cavity and intersect with the undercut and perimeter of the cavity. The buttresses taper from their narrowest diameter at their intersection with the cavity surface to a greater diameter at their non-intersecting outer surface and the buttresses greatest diameter is at the point where the buttress intersects with the perimeter of the cavity. The lightweight web-like structure is comprised of tapered buttresses which intersect with the rear cavity surface and cavity perimeter and serves to strengthen and reinforce the hitting surface of the club head, keeping the hitting surface rigid during impact with the golf ball thus eliminating face deflection during impact and providing maximum energy transfer to the golf ball.

7 Claims, 5 Drawing Sheets

SET OF GOLF CLUB IRONS

CROSS-REFERENCE TO RELATED APPLICATIONS

The present application depends for priority on Provisional Patent Application Serial No. 60/116,939 filed on Jan. 23, 1999.

BACKGROUND OF THE INVENTION

1. Field of the Invention

The present invention relates generally to the field of golf clubs and more specifically, to a set of golf club iron heads in which each such head has a rear cavity and features a redistribution of weight toward the cavity perimeter by employing a thin, lightweight hitting surface which has a plurality of radially extending rear buttresses to resist hitting surface deformation at ball impact.

2. Background Art

Cavity back clubs perform better on off-center hits if: a) weight is removed from the back of the club head creating a cavity; b) weight that is removed is redistributed to the perimeter of the club head; c) the result is a club head that is more stable on impact and deflects less on off-center hits. Off-center hits travel longer and straighter than none cavity back or muscle back designs. Recently larger club heads with larger cavities have proliferated the market. Regardless of manufacture, most iron club head weights are within a few grams of each other (i.e., PING® No. 5=258 grams, CALLAWAY® No. 5=258 grams, WILSON® No. 5=260 grams, etc. (256–262 grams industry standard) therefore the larger the club head designs are limited as to how and where weight can be distributed and still produce the desired performance benefits. A large club head with a larger cavity and thin face would more likely to produce a hitting surface which would deflect/deform at impact thereby reducing energy that would normally be transferred to the ball thus a reduction in performance. A large club head with a large cavity and a thick face would not necessarily deflect or deform, but such a design would tend to have less mass distributed to the perimeter resulting in a less stable club at impact and thus a reduction in performance particularly on off-center hits.

Club heads have been produced with thin face cavities. However, such designs usually produce loud, annoying sounds at impact due to the deflection of the thin face thereof in which acoustic material is attached to dampen the sound.

Depending on the size of the cavity and face thickness of such clubs, some of which use undercuts in the perimeter area to increase effective cavity size, additional acoustic dampening material is attached to or around the back surface of said cavity thereby dampening/quieting the impact sound. It is difficult to produce a club head with a thin face that would not momentarily or permanently deform/deflect at impact and still deliver satisfactory performance. Further it would be difficult to produce a club head with a thin face which would enhance performance on one hand and on the other, sound pleasing at impact.

SUMMARY OF THE INVENTION

The present invention comprises an iron head wherein the face thickness is reduced as much as possible and still retains a rigid hitting surface thus allowing the maximum amount of mass in the cavity to be redistributed to the perimeter of said cavity. Such a design results in ball trajectory and dispersion which is more accurate despite off-center hits away from the sweet spot of the golf club face or hitting surface. One way of achieving this is to reduce the face thickness to the point where the hitting surface deflects or deforms upon impact with the ball. The cavity area is modified to accept a lightweight web-like structure which protrudes away from the center of the cavity outward and intersects with the perimeter of the cavity. Thus, the web-like structure has a buttressing effect on the cavity, hitting surface and club head perimeter thus providing a rigid hitting surface. Because the web-like structure separates the cavity into sections, the thickness of the hitting surface can be varied to enhance weight distribution, sound and club head dynamics (i.e., weight placed high and toward the toe will cause the club head to rotate faster than if the same weight were to be placed low and toward the toe).

The present invention overcomes the disadvantages of the prior art by providing a set of golf club irons in which each such iron achieves selective weight distribution. This is accomplished by:

1) Removing weight in the back cavity of the club head and redistributing it to the perimeter of the club head, particularly to the top line, heel, toe and sole.
2) Removing weight in the back cavity to create a very thin hitting surface allowing for additional weight to be redistributed to the club head perimeter. Such a thin hitting surface would flex, deflect or deform either momentarily or permanently upon normal impact with the golf ball.
3) The thin hitting surface is supported by a lightweight web-like structure which acts as a reinforcing buttress preventing flexing, deflecting or deforming; in effect, a rigid hitting surface.
4) A cavity which has a very thin hitting surface supported by a lightweight web-like structure which acts as a reinforcing buttress creating a non-flexing, deflecting or deforming, in effect, a rigid hitting surface. Such lightweight web-like structure separates the cavity into sections such that the face thickness of the hitting surface can be varied to enhance the impact sound and hitting dynamics of the club head.

OBJECTS OF THE INVENTION

It is therefore a principal object of the present invention to provide an improved golf club iron head design wherein weight normally in the hitting surface is redistributed to the perimeter of the head rear cavity by thinning the hitting surface and buttressing the rear of the hitting surface with a plurality of radially extending buttress members to prevent or substantially reduce hitting surface deformation at ball impact.

It is another object of the invention to provide a more forgiving golf club iron by employing a lighter weight hitting surface the rear area of which is reinforced by a plurality of web-like sections, the sections being separated from one another by radial buttresses extending toward the perimeter of the rear cavity of the iron head.

It is yet another object of the invention to provide a golf club iron head in which redistribution of weight toward the head perimeter is facilitated by employing either thinner or lower density material hitting surfaces, or both while concurrently preventing or reducing hitting surface ball impact deformation by reinforcing the hitting surface with a plurality of stiffening buttresses.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF PREFERRED EMBODIMENTS

Figure 1:
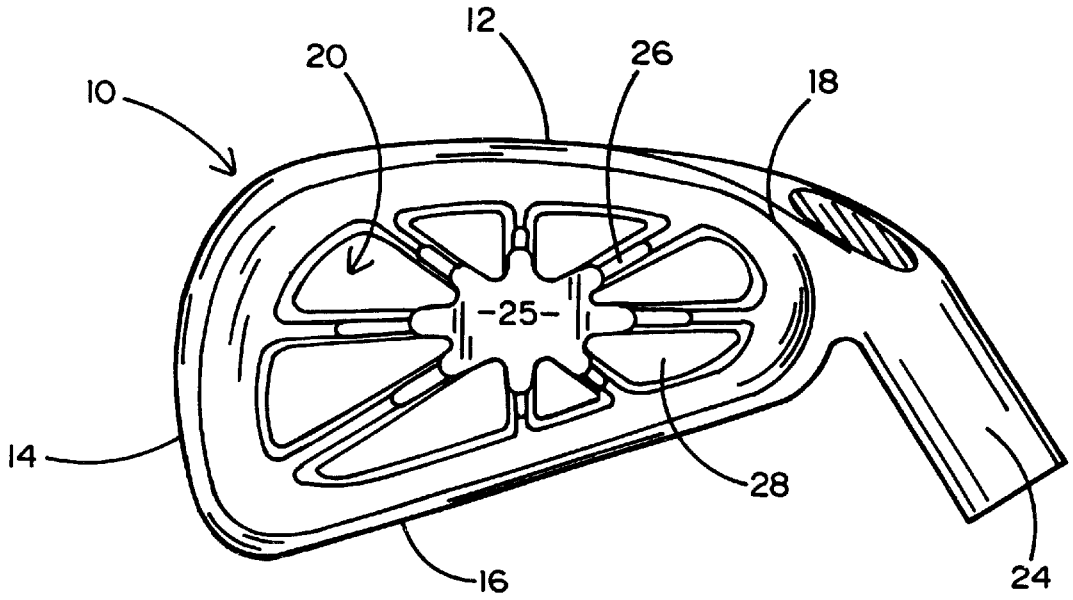
FIG. 1 is a rear elevational view of a first embodiment of the invention.
Figure 2:
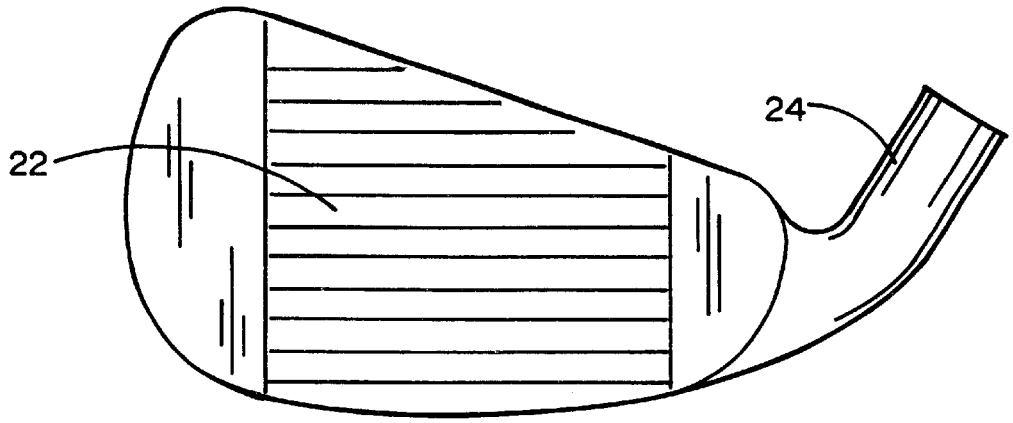
FIG. 2 is a front elevational view thereof.
Figure 3:
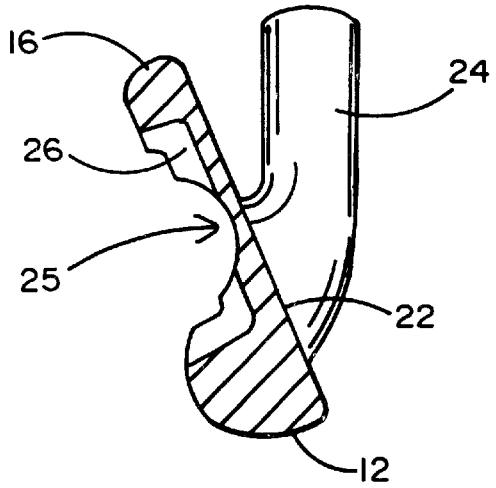
FIG. 3 is a cross-sectional side thereof.
Figure 4:
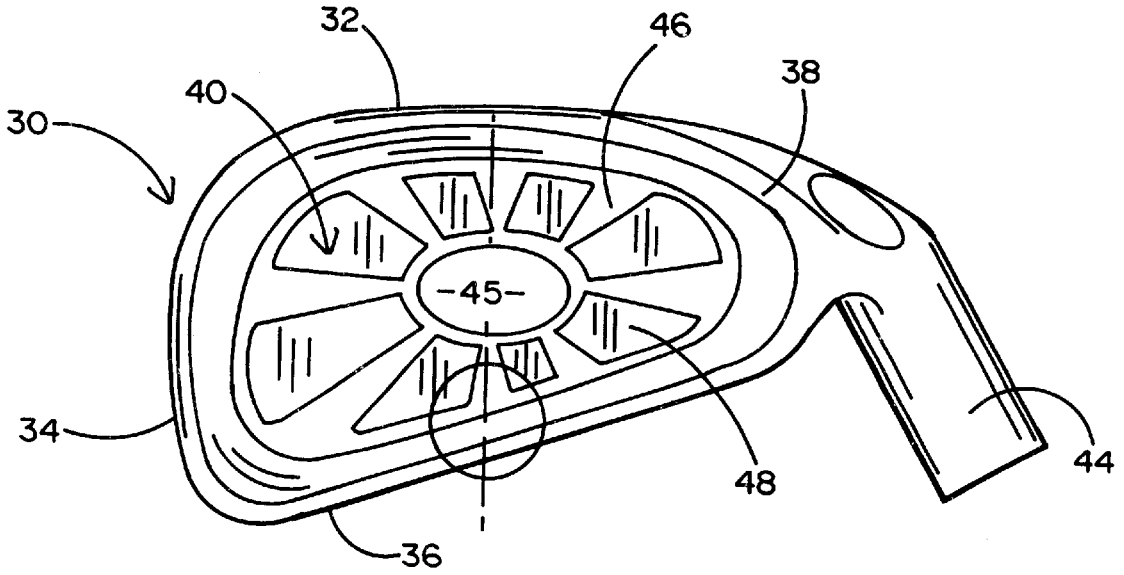
FIG. 4 is a rear elevational view of a second embodiment of the invention.
Figure 5:
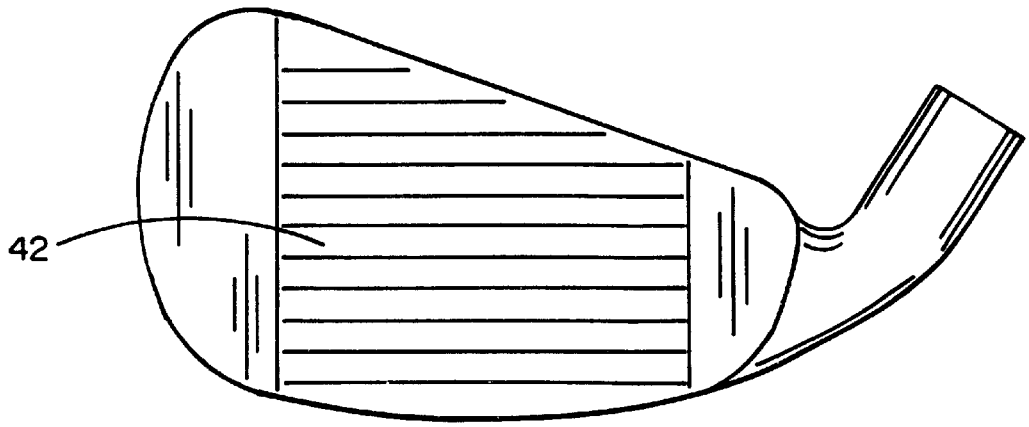
FIG. 5 is a front elevational view thereof.
Figure 6:
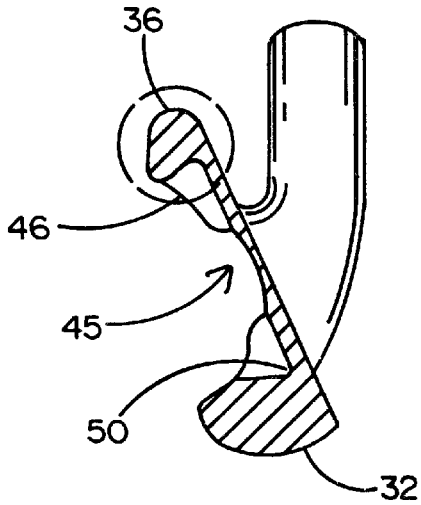
FIG. 6 is a cross-sectional side thereof.
Figure 7:
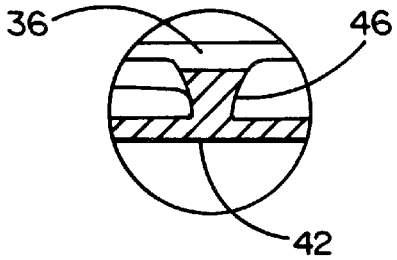
FIG. 7 is an enlarged view of the encircled portion of FIG. 6.

As seen in the accompanying figures, in a first embodiment of the invention of FIGS. 1–3, an iron head 10 comprises a sole 12, a toe 14, a topline 16 and a heel 18. These surfaces define a rear 20 and a face 22 and extend integrally from a hosel 24. The rear 20 comprises a thin central region 25 from which there extends a plurality of radially extending buttresses 26 at spaced angles and forming a plurality of web-like regions 28.

Figure 8:
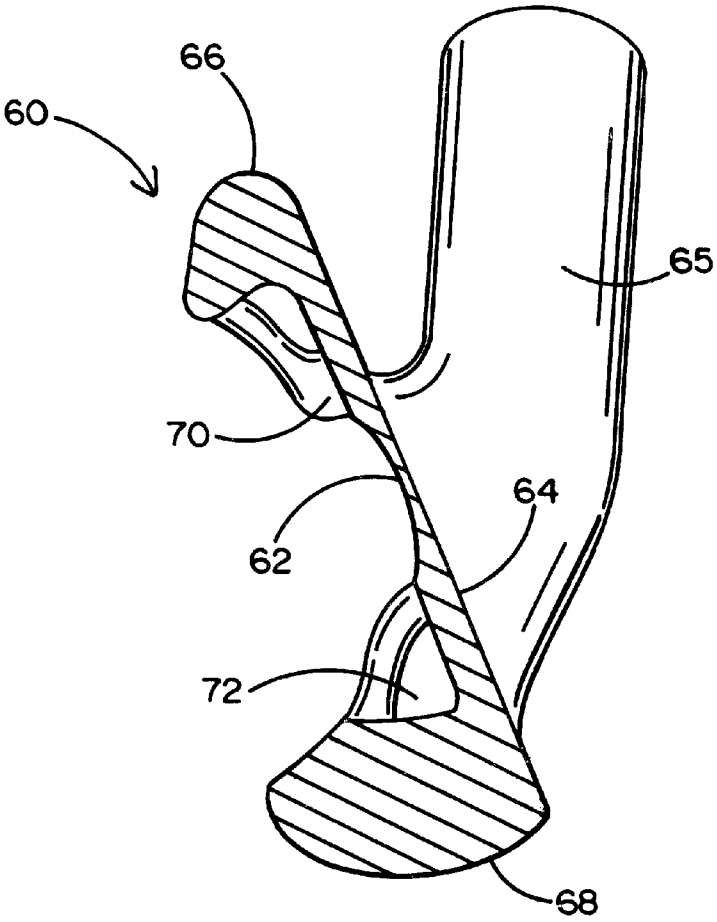
FIG. 8 is a cross-sectional side view of a third embodiment of the invention.

In a second embodiment shown in FIGS. 4–7, there is a similar structure in that head 30 comprises sole 32, toe 34, topline 36, heel 38, hosel 44, rear 40 and face 42. A thin central region 45, buttresses 46 and web-like regions 48 form the principal features of the invention. The second embodiment differs from the first in that head 30 has a rear cavity perimeter characterized by an undercut 50 extending around the entire head. The embodiment of FIG. 8 comprises a head 60 having rear 62, face 64, topline 66, sole 68 and hosel 65. Buttresses 70 are unique in this embodiment in that they are partially spaced from the rear cavity by gaps 72 thus in effect forming "flying buttresses".

Figure 9:
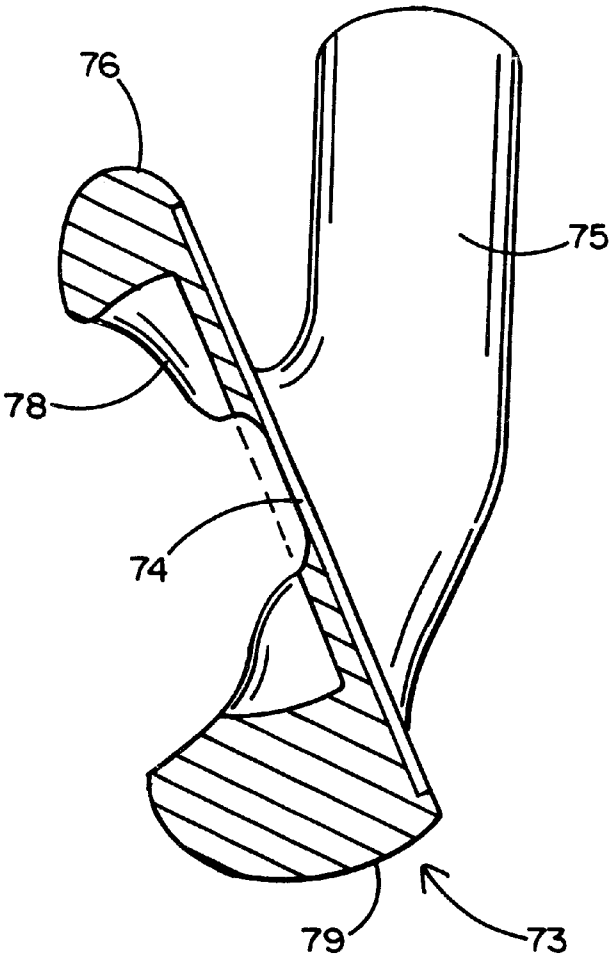
FIGS. 9 and 10 are cross-sectional side views of fourth and fifth embodiments of the invention, respectively.
Figure 10:
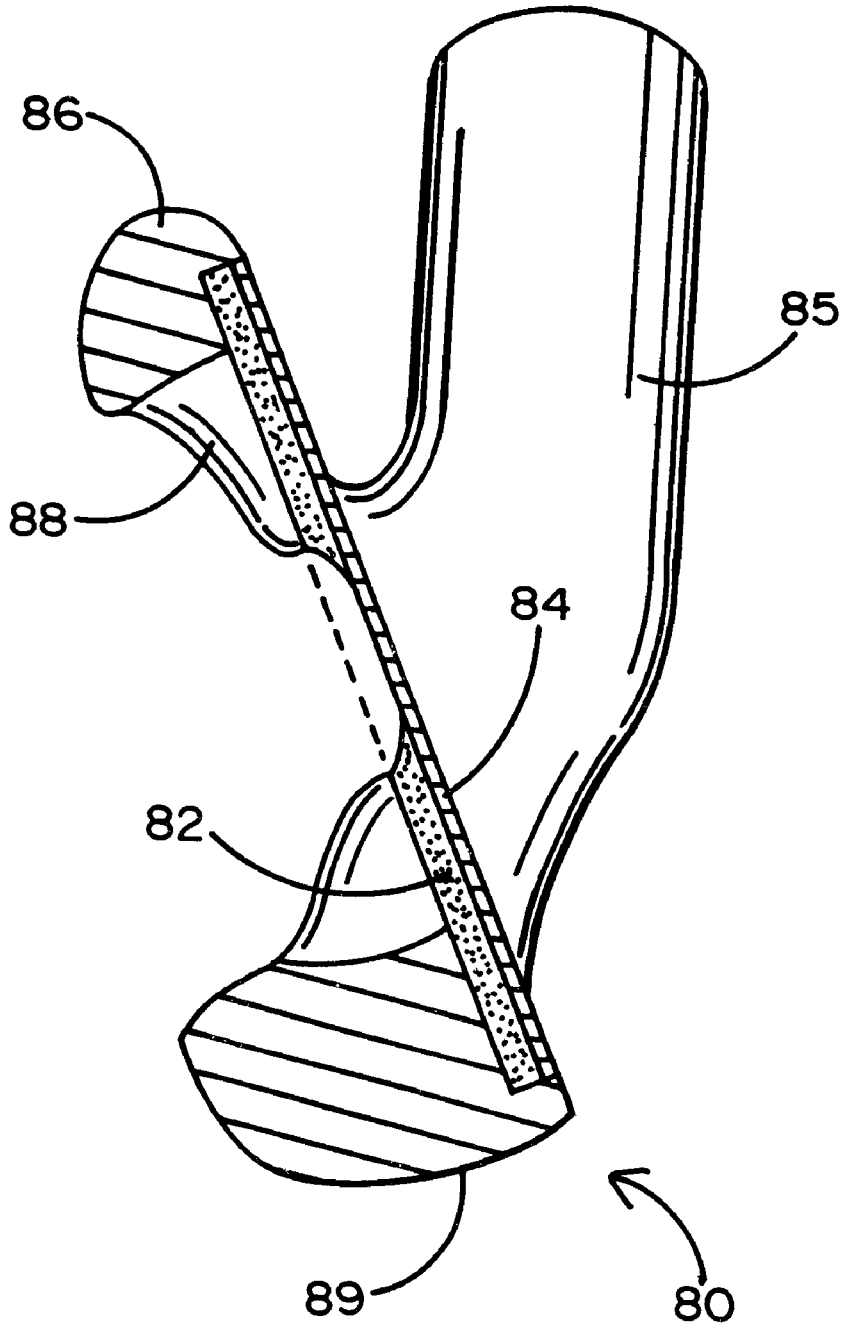

The embodiment of FIGS. 9 and 10 employ inserts for their respective faces. Head 73 of FIG. 9 has an insert 74 forming the entire hitting surface formed between a topline 76, a sole 79 and a hosel 75. In the central area of the head, insert 74 is the only material, but is supported outside that central area by radially extending buttresses 78 in the manner described above. In the embodiment of FIG. 10, there is a head 80 having a dual surface insert assembly comprising insert 82 and insert 84 and forming the entire hitting surface formed between topline 86, sole 89 and hosel 85. Radially extending buttresses 88 provide the hitting surface support as in the other embodiments.

Having thus described a number of alternative illustrative embodiments, it being understood that yet other various embodiments and modifications of those shown herein are contemplated, what is claimed is:

1. A golf club iron head having a sole, a heel, a toe and a topline defining a substantially planar member one side of which is the hitting surface of the head and the opposing side of which defines a rear cavity of the head, the cavity being substantially enclosed by a perimeter which is thicker than the planar member; the head comprising:

a plurality of buttresses within said cavity, said buttresses extending along said opposing side of said planar member for reinforcing said planar member against deformation upon impact of said hitting surface with a golf ball;

said hitting surface having a sweet spot which is substantially at the center of said planar member, said buttresses extending radially from said sweet spot toward said perimeter;

said planar member is thinner at said sweet spot than it is toward said perimeter.

2. The golf club recited in claim 1 wherein said planar member comprises a material that differs from the material from which the remainder of the head is made.

3. The golf club recited in claim 1 wherein said planar member comprises a plurality of distinct, abutting members.

4. The golf club head recited in claim 3 wherein each of said distinct, abutting members comprises a material that differs from the material from which the remainder of the head is made.

5. A golf club iron head having a sole, a heel, a toe and a topline defining a substantially planar member one side of which is the hitting surface of the head and the opposing side of which defines a rear cavity of the head, the cavity being substantially enclosed by a perimeter which is thicker than the planar member; the head comprising:

a plurality of buttresses within said cavity, said buttresses extending along said opposing side of said planar member for reinforcing said planar member against deformation upon impact of said hitting surface with a golf ball;

said hitting surface having a sweet spot which is substantially at the center of said planar member, said buttresses extending radially from said sweet spot toward said perimeter;

said buttresses are spaced from said planar member adjacent said perimeter.

6. A set of golf club irons each having a head having a rear cavity surrounded by a perimeter and each head having a planar ball-hitting member forming a planar wall of the cavity; the irons comprising:

a plurality of ball-hitting member reinforcing buttresses extending along said planar wall;

said planar wall having a central portion said central portion being thinner than the remainder of said planar wall;

said reinforcing buttresses extend radially from said central portion toward said perimeter forming a plurality of web areas between said buttresses.

7. The set of irons recited in claim 6 wherein each of said ball-hitting member comprises at least one planar insert, said insert being made of a material having a different density than the remainder of each said head.

* * * * *